United States Patent [19]

Blechschmidt

[11] Patent Number: 4,489,929

[45] Date of Patent: Dec. 25, 1984

[54] MODULAR CLAMPING SYSTEM

[76] Inventor: Wolf J. Blechschmidt, 16421 Northeast 18th St., Bellevue, Wash. 98008

[21] Appl. No.: 412,909

[22] Filed: Aug. 30, 1982

[51] Int. Cl.[3] ..... B25B 1/24

[52] U.S. Cl. ..... 269/282; 269/252

[58] Field of Search ..... 269/99–101, 269/25, 134, 136, 221, 252, 253, 277, 279–284, 286, 266

[56] References Cited

U.S. PATENT DOCUMENTS

| | | | |
|---|---|---|---|
| 1,499,989 | 7/1924 | Lehmann | 269/101 |
| 4,191,367 | 3/1980 | Speiser et al. | 269/203 |
| 4,223,879 | 9/1980 | Wolfe et al. | 269/136 |
| 4,251,066 | 2/1981 | Bowling | 269/283 |

*Primary Examiner*—Frederick R. Schmidt
*Assistant Examiner*—Judy J. Hartman
*Attorney, Agent, or Firm*—Seed and Berry

[57] ABSTRACT

A modular clamping system for fixturing workpieces with respect to a numerically controlled drilling and boring machine or the like includes a pair of soft jaw blocks which may be variably spaced with respect to one another in fixed positions to hold the workpiece therebetween. A vice assembly preferably holds the soft jaw blocks in a fixed position during use by way of several vertical and horizontal alignment mechanisms. Cavities to hold the workpieces in place are machined in the soft jaw blocks by the NC machine prior to each job to accurately reference the workpiece with respect to the NC machine.

8 Claims, 5 Drawing Figures

MODULAR CLAMPING SYSTEM

DESCRIPTION

1. Technical Field

This invention relates to a clamping system for holding a piece being worked on by a numerically controlled drilling and milling machine, and more particularly, to a modular clamping system for holding such pieces.

2. Background Art

Numerically controlled drilling and milling machines are machines which are programmable to automatically perform a series of drilling and milling tasks on a workpiece positioned under the machine. These machines, known as "NC" machines, are programmed to control movement of a drilling or boring tool located within the machine to perform desired drilling or boring tasks. The program will precisely control movement of the tool with respect to X and Y axes on a horizontal reference place over the workpiece, as well as vertical movement of the tool.

As changing tools on an NC machine requires time, a plurality of workpieces are often positioned under the NC machine and the machine is programmed to perform a single task on all of the workpieces under the machine before moving on to the next task in the series. When this is done, the machine operator need only load the desired number of workpieces in fixtures under the NC machine, activate the machine to perform the desired tasks, remove the completed workpieces, and replace them with new workpieces.

Although NC machines are capable of accurately placing the drilling tool at a desired point on the horizontal reference plane in response to input from the machine program, the placement of the workpiece with respect to the reference plane must be equally accurate to hold close tolerances. If the workpiece is positioned slightly off-center from its reference location, for example, the holes drilled by the NC machine will be incorrectly located. Similarly, if the workpiece is sitting slightly higher than assumed by the NC machine program, the holes will be incorrectly drilled too deep.

Traditionally, collets or "step chucks" have been commonly used for fixturing workpieces. Because these collets engage a workpiece with inclined surfaces, however, any error in placement with respect to the horizontal reference plane often represents a magnified error with respect to vertical dimensions. Additionally, collets are susceptible to problems resulting from contamination from machining chips.

Devices known as "soft jaws" are often used for fixturing workpieces to avoid the difficulties inherent in collets. Soft jaws are solid blocks, usually of aluminum, into which one or more cavities are machined to hold workpieces. As these cavities will have a constant vertical depth, the magnified errors present in vertical dimensions when collets are used are greatly reduced. It is still neccessary, however, to align the workpiece cavities of the soft jaws precisely with respect to the horizontal reference place of the NC machine. This alignment is normally accomplished by placing a cavity-free soft jaw in a vice or the like to secure it under the NC machine. The cavity for holding the workpiece may then be machined by the NC machine program itself, thereby tying the location of the cavity to the location of the remainder of the tasks to be performed on the workpiece. The unfortunate consequence of this procedure is that a soft jaw must generally be used only once and then discarded. Should a workpiece considerably larger than the cavity in an existing soft jaw need to be held, it is possible to remachine a larger cavity in the soft jaw and reuse it.

DISCLOSURE OF INVENTION

It is an object of this invention to provide a modular clamping system which can securely hold a workpiece in a location accurately referenced to a companion machine, such as a numerically controlled drilling machine.

It is another object of this invention to provide such a modular clamping system which will permit multiple uses of the components thereof before they must be discarded.

These and other objects, which will become more apparent as the invention is more fully described below, are obtained by providing a modular clamping system for fixturing workpieces with respect to an NC machine or the like which includes a pair of soft jaw blocks which may be variably spaced with respect to one another in fixed positions to hold a workpiece therebetween. The soft jaw blocks are preferably separated by a spacer which may be of varying size, depending upon the separation desired. A vice assembly holds the soft jaw blocks in a fixed position during use by means of several horizontal and vertical alignment mechanisms. Once the soft jaw blocks are steadily secured by the vice assembly, a cavity sized to snugly hold a workpiece is machined in the soft jaw blocks by the NC machine in accordance with the machine program. This procedure ensures accurate referencing of the workpieces which will be held in the cavity. When close tolerances are required, new cavities must be drilled with each setup. The cavities are preferably machined so that the center of the workpiece is held over the spacer, thereby allowing each soft jaw block to be machined in equal amount when symmetrical workpieces are to be held. The size of the machined portion of the soft jaw blocks of this invention will be a function not only of the size of the workpiece, but of the spacer size as well. Thus, the jaw blocks may be remachined for later use with a spacer of reduced size, even though the workpiece to be held is not larger than the previous piece for which the soft jaw blocks were used.

BEST MODE FOR CARRYING OUT THE INVENTION

Figure 1:
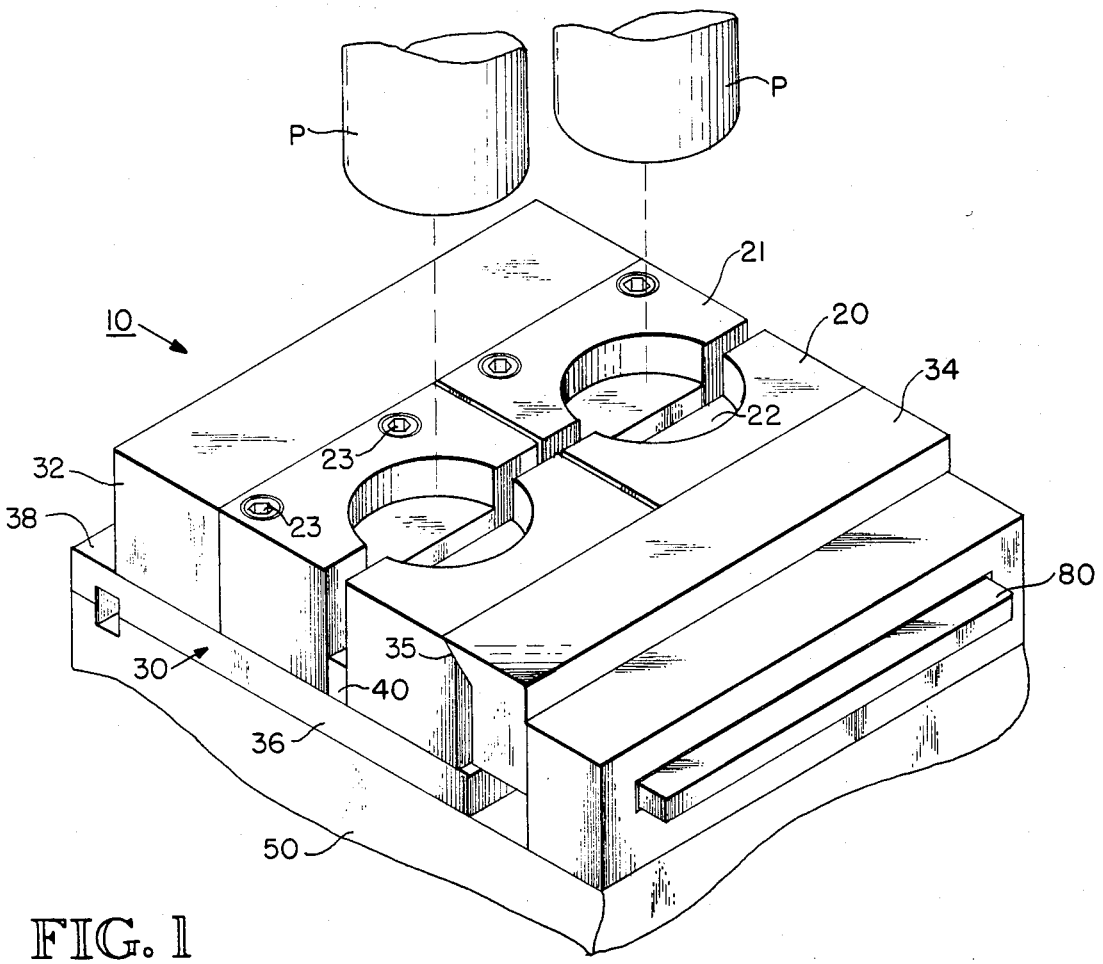
FIG. 1 is an isometric view of a preferred embodiment of the modular clamping system with cavities machined in two pairs of soft jaw blocks to receive a cylindrical workpiece.
Figure 2:
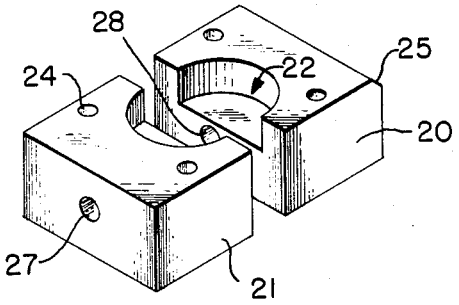
FIG. 2 is an isometric view of one pair of soft jaw blocks.

A modular clamping system 10 comprising a preferred embodiment of the present invention is shown in FIG. 1. Two pairs of soft jaw blocks 20,21 have been machined by a companion NC machine (not shown) to produce cavities 22 for fixturing workpieces P while drilling and boring tasks are being performed on the workpieces P by the NC machine. The soft jaw blocks 20,21 of each pair are separated by a spacer 40 and secured in placed by a vice assembly 30. The vice assembly 30 includes a support 36 on which the soft jaw blocks 20,21 and spacer 40 rest, and a stationary vice jaw 32 and a movable vice jaw 34 which combine with several alignment mechanisms (described below) to fixedly hold the soft jaw blocks 20,21 in place.

When setting up to perform a series of drilling tasks using an NC machine, soft jaw blocks 20,21 are placed on the support 36 and separated by the spacer 40 and secured in place by vice assembly 30. Cavities 22, sized to snugly hold the workpieces P in place, are then machined by the NC machine in accordance with instructions from the NC program. The location of the workpieces P, thereafter fixtured within the cavities, is thereby accurately referenced to enable close tolerances to be maintained while machining the workpieces.

Figure 3:
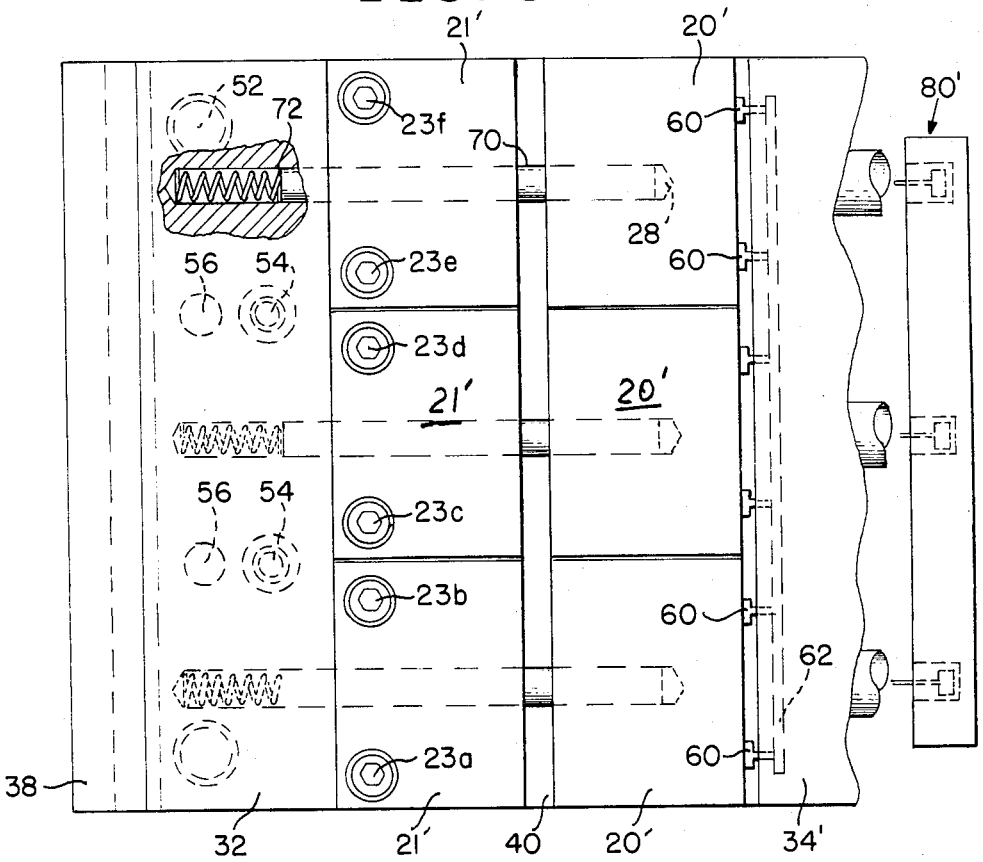
FIG. 3 is a top plan view of a preferred embodiment of the modular clamping system with three pairs of soft jaw blocks mounted therein.
Figure 4:
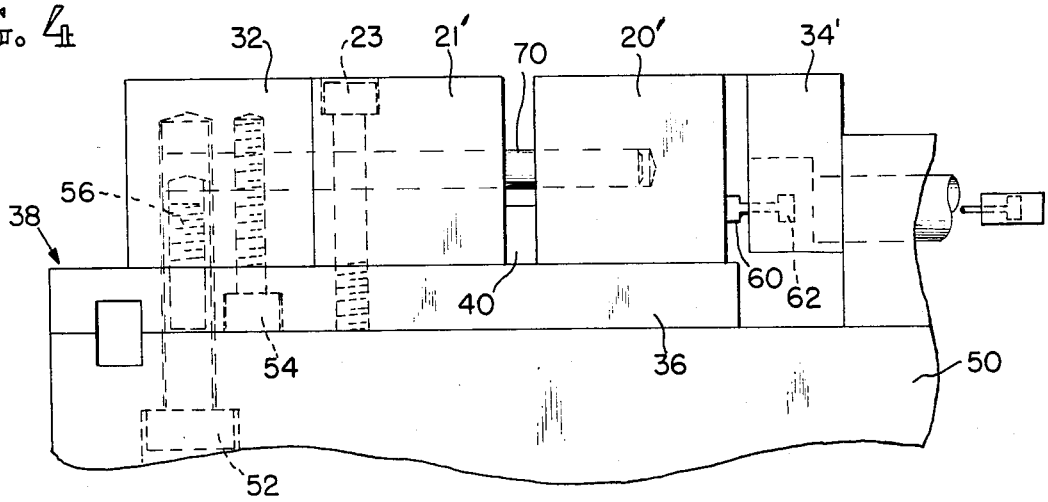
FIG. 4 is a side elevation view of the modular clamping system illustrated in FIG. 3.
Figure 5:
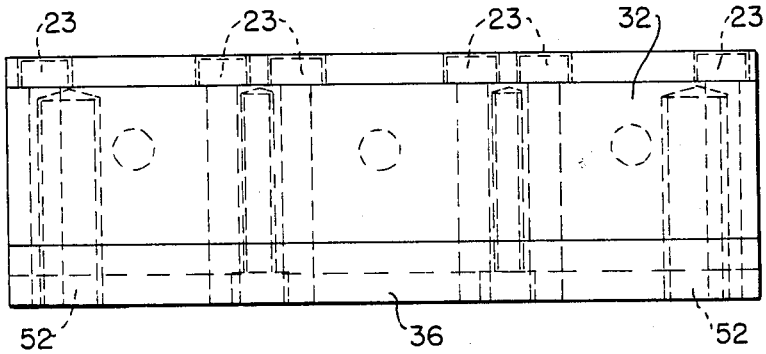
FIG. 5 is a rear elevation view of the modular clamping system illustrated in FIG. 3.

The components of the vice assembly 30, including the alignment mechanisms which secure the soft jaw blocks 20,21 in place and ensure accurate referencing of the workpieces P, are best seen in FIGS. 3–5. Three pairs of soft jaw blocks 20',21' are positioned atop the support 36, which includes a planar slide face 38 on the top thereof on which the soft jaw blocks 20',21' rest. The planar slide face 38 is carefully machined to ensure accurate vertical positioning of the soft jaw blocks 20', 21'.

Each pair of soft jaw blocks 20',21' includes a stationary soft jaw block 21' and a sliding soft jaw block 20'. The stationary soft jaw blocks 21' abut the stationary vice jaw 32, which is rigidly affixed to the support 36 and an underlying vice base 50 by means of bolts 52,54,56, which extend into the underside of the stationary vice jaw 32, as best seen in FIGS. 3 and 4. The stationary vice jaw 32 is thereby rigidly secured to the vice base 50 to form a stop block. The stationary soft jaw blocks 21 are secured in place by vertical fasteners 23 which extend the support 36 through vertical apertures 24 in the stationary soft jaw blocks 21'.

The sliding soft jaw blocks 20' are spaced apart from the stationary soft jaw blocks 21' by the spacer 40. Movable vice jaws 34,34' are activated by a conventional hydraulic actuation mechanism 80,80' to bias the sliding soft jaw blocks 20' toward the spacer 40 to hold the sliding soft jaw blocks 20' in place. The movable vice jaw 34, illustrated in FIG. 1, includes a rigid leading edge 35 which is inclined to contact the sliding soft jaw blocks 20. Sliding soft jaw blocks for use with an inclined leading edge 35 include a beveled upper outside corner 25 for engagement with the inclined leading edge 35. An alternative embodiment of the movable vice jaw 34' is illustrated in FIGS. 3 and 4. This movable vice jaw 34' is a conventional hydra-jaw, which comprises a plurality of compressible rods 60 which are hydraulically coupled to a common reservoir 62 for equalization. The rods 60 project outwardly from the main portion of the movable vice jaw 34' to form the contact points with the sliding soft jaw blocks 20'. The use of a hydra-jaw or similar arrangement for the movable vice jaw is preferred for securing multiple pairs of soft jaw blocks 20',21' within a single vice assembly 30. As slight dimensional variations in the soft jaw blocks 20', 21' or the clamped workpiece may cause the sliding soft jaw blocks 20' not to align perfectly, the use of a movable vice jaw which can apply equalizing pressure to the contact surfaces of the various sliding soft jaw blocks 20' is preferred. A hydra-jaw or similar setup allows the movable vice jaw 34' to firmly bias each sliding soft jaw block 20' toward the spacer 40 to ensure that it is held firmly in place.

As seen in FIGS. 3 and 4, each sliding soft jaw block 20' is aligned and secured with respect to its corresponding stationary soft jaw block 21' by means of a horizontal alignment rod 70. The alignment rods 70 are spring loaded in apertures in the stationary vice jaw 32 and extend through apertures 27' in the stationary soft jaw block 21' into cavities 28' within each sliding soft jaw block 20', as seen in FIGS. 3 and 4. The alignment rods 70 are biased outwardly toward the soft jaw blocks 20',21' by springs 72, as seen in FIG. 3 to facilitate the use of spacers 40 of varying size, as discussed below.

The vice assembly illustrated in the preferred embodiments shown in FIG. 1 and FIGS. 3,4,5 is set up for use with up to three alignment rods 70 and up to six vertical fasteners 23. When two pairs of soft jaw blocks 20,21 are used with the vice assembly 30 (as shown in FIG. 1), four vertical fasteners 23 and two alignment rods 70 are preferably used. When three pairs of soft jaw blocks 20', 21' are used with the vice assembly 30 (as shown in FIG. 3), six vertical fasteners 23 and three alignment rods 70 are preferably used. As can be seen by comparing the alphabetic subscripts on the vertical fasteners 23 of FIGS. 1 and 3, vertical fasteners **23*b* and 23*e* are preferably omitted when securing only two soft jaw blocks 20,21 within the vice assembly 30. The number of apertures within the support 36 of the vice assembly 30 could, of course, be increased or decreased to facilitate placement of various size and number of soft jaw blocks. It is not intended that the invention be limited to the specific arrangement disclosed herein. Similarly, the vice assembly 30 could be modifed to accommodate additional alignment rods 70** is so desired.

The amount of each soft jaw block 20,21 which must be machined to form cavities 22 for fixturing the workpieces P will be determined by the width of the spacer 40 which is selected. It is preferred that for the initial uses of the soft jaw blocks 20,21, relatively large spacers 40 be employed so that a minimum amount need be removed from the soft jaw blocks 20,21 when the cavities 22 are machined. When the soft jaw blocks 20,21 are reused for another setup, a smaller spacer 40 will preferably be employed. This will permit the soft jaw blocks 20,21 to be reused even if the cavity needed for the new setup is not substantially larger than the cavity used for the previous setup. If a substantially larger workpiece is to be used, however, it may be desired that a relatively large spacer 40 is still employed to minimize the amount of the soft jaw blocks 20,21 which must be removed. It can be seen that by carefully selecting different size spacers 40, the soft jaw blocks 40,41 may be utilized to their maximum potential before being discarded.

Although the modular clamping system of this invention has beed described herein with respect to two preferred embodiments, it is not intended that the invention by limited to those embodiments. The particulars of the vice assembly, for example, could be varied without departing from the spirit of the invention. Additionally, although the invention has been described herein with respect to soft jaw blocks used to fixture relatively small workpieces, the same principle could be used to fixture any type of workpiece. It it were desired to fixture a two-inch wide ring having an inside diameter of two feet, for example, four pairs of soft jaw blocks could be positioned at locations spaced 90 degrees apart on the ring. The NC machine which is to perform the drilling and boring tasks on the ring would machine each of the soft jaw blocks to fixture the ring in the same manner as with a smaller workpiece. It is intended that the invention include all equivalent embodiments which are within the spirit of the invention, and not be limited to the specific embodiments disclosed herein.

I claim:

1. A soft jaw system comprising:

vice means having a planar slide face and opposing fixed and movable vice jaws at opposite sides of the slide face;

soft removable jaw block means resting flat on said slide face and comprising a stationary jaw block opposed by said fixed vice jaw and a slide jaw block between said fixed jaw block and movable vice jaw to be engaged by the latter;

alignment pin means parallel to said slide face and interfitting with said fixed vice jaw, stationary jaw block and slide jaw block, said alignment pin means comprising a pin projecting from said slide jaw block and slidably passing through said stationary jaw block into said fixed vice jaw;

spring means in said fixed vice jaw for yieldingly urging said pin away from said fixed vice jaw; and detachable hold-down means clamping said stationary jaw block against said slide surface.

2. A soft jaw system according to claim 1 in which said hold-down means comprises an anchor bolt passing through said stationary jaw block and through said slide face into said vice means.

3. A soft jaw system according to claim 1 in which said vice means includes a vice base, a base plate detachably mounted on the vice base and providing said slide surface, and a stop block detachably anchored to said base plate and serving as said fixed vice jaw.

4. A soft jaw system according to claim 3 in which bolts pass through said base plate into said stop block to anchor the stop block to the base plate.

5. A modular jaw system comprising:

vice means having a planar slide face and opposing fixed and movable vice jaw means at opposite sides of the slide face;

side-by-side sets of removable soft jaw block means resting flat on said slide face, each set comprising a stationary jaw block opposed by said fixed vice jaw means and a slide jaw block between said fixed vice jaw means and movable vice jaw means to be engaged by the latter;

each said set having a respective alignment pin means parallel to said slide face and interfitting with said fixed vice jaw means, the respective stationary jaw block and slide jaw block of the set;

means for biasing said pin means away from said fixed jaw means; and detachable hold-down means clamping the stationary jaw blocks of said sets against said slide surface.

6. A modular soft jaw system comprising:

a base plate adapted to be mounted on a base of a vice having a movable vice jaw, said base plate presenting a planar slide face;

a fixed block anchored to said base plate and extending beyond a plane of said slide face to be a fixed vice jaw for opposing said movable vice jaw;

side-by-side sets of removable soft jaw block means resting flat on said slide face, each set comprising a stationary block opposed by said fixed block and a slide jaw block for being engaged by said movable vice jaw;

alignment means interfitting with said fixed and said soft jaw block means for keeping said sets in parallel relation to one another;

spring means for yieldingly urging said alignment away from said fixed block; and bolt means clamping the stationary jaw blocks of said sets against said slide surface.

7. A modular soft jaw system comprising:

a base plate and stop block unit presenting a planar slide face and a planar stop face having their planes meeting as a dihedral angle, said unit being adapted to be mounted on a base of a vice with said stop face opposing a movable jaw of the vice;

said unit having side-by-side sets of bolt holes exposed at said stop face for receiving hold-down bolts for anchoring the stationary blocks of sets of side-by-side jaw block means, each comprising a stationary jaw block and a slide jaw block resting flat on said slide face for being engaged by said movable vice jaw;

said unit also having for each said set of bolt holes an alignment hole parallel to said slide face and exposed at said stop face for receiving a respective alignment pin extending from the slide jaw block of the respective set of jaw block means through the stationary jaw block therof;

compression springs mounted in said alignment holes for engagement by said pins; and an alternative set of bolt holes arranged to receive hold-down bolts for anchoring the stationary jaw block of an alternative set of such jaw block means which has a larger stationary jaw block and slide jaw block than the first-mentioned sets of jaw block means, said alternative set of bolt holes also being arranged so that one of said alignment holes will receive an alignment pin for the alternative set of jaw block means.

8. A system according to claim 7 in which all of said bolt holes are threaded.

* * * * *